US005558336A

United States Patent [19]

Sapello

[11] Patent Number: 5,558,336

[45] Date of Patent: Sep. 24, 1996

[54] BOARD GAME AND METHOD OF PLAYING

[76] Inventor: Donald Sapello, 207 Coari Ave., Minotola, N.J. 08341

[21] Appl. No.: 411,283

[22] Filed: Mar. 27, 1995

[51] Int. Cl.[6] ..... A63F 3/00

[52] U.S. Cl. ..... 273/281; 273/282.1

[58] Field of Search ..... 273/236, 241, 273/281, 282.1, 282.3, 288, 153 S

[56] References Cited

U.S. PATENT DOCUMENTS

| | | | |
|---|---|---|---|
| 818,582 | 1/1906 | Thomas | 273/282.1 |
| 1,085,941 | 2/1914 | Russell | 273/281 |
| 1,206,334 | 4/1916 | Kohler . | |
| 1,666,359 | 4/1928 | Steves | 273/282.1 X |
| 1,700,016 | 1/1929 | Belanger | 273/281 |
| 1,714,792 | 5/1929 | Kurihara . | |
| 2,528,792 | 11/1950 | Seaman . | |
| 3,124,357 | 3/1964 | Preston | 273/281 |
| 3,130,972 | 4/1964 | Schwarzlander | 273/282.1 |
| 3,165,318 | 1/1965 | Lissandrello | 273/282.1 |
| 3,402,934 | 9/1968 | Adams | 273/282.1 X |
| 3,695,615 | 10/1972 | Shoptaugh | 273/282.1 |
| 4,074,907 | 2/1978 | Curtis | 273/282.1 |
| 4,470,601 | 9/1984 | Finn | 273/281 X |
| 4,486,017 | 12/1984 | Evert | 273/281 X |
| 4,524,971 | 6/1985 | Sasso | 273/281 X |
| 5,333,877 | 8/1994 | Pridgeon et al. | 273/281 X |
| 5,431,400 | 7/1995 | Metz | 273/282.1 X |

FOREIGN PATENT DOCUMENTS

| | | | |
|---|---|---|---|
| 397065 | 11/1990 | European Pat. Off. | 273/282.1 |
| 2202753 | 10/1988 | United Kingdom | 273/281 |

*Primary Examiner*—William E. Stoll

*Attorney, Agent, or Firm*—Wigman, Cohen, Leitner & Myers, P.C.

[57] ABSTRACT

A board game, and a method of playing thereof, in which a plurality of directionally-oriented playing pieces are slidably advanced through a grid of intersecting grooves of the game board to achieve a predetermined sequence of playing pieces in a desired configuration while blocking advancement of an opposing player's playing pieces. The game board is supported in an inclined position to cause the playing pieces to advance into position under the force of gravity. The method of playing the game requires strategic analysis and foresight so as to achieve desired sequential alignment of playing pieces.

9 Claims, 1 Drawing Sheet

BOARD GAME AND METHOD OF PLAYING

FIELD OF THE INVENTION

The present invention relates to a board game and a method of playing thereof, and more particularly to a board game having a game board including a series of intersecting grooves in which a plurality of playing pieces are strategically located.

BACKGROUND OF THE INVENTION

Board games are well known and widely used for educational, recreational and entertainment purposes. The playing of board games helps to promote logical and reasoned approaches to multi-faceted problems requiring forethought and reasoned consideration and application of the best of possibly numerous approaches in an effort to successfully complete the game.

Various board games have been devised to enhance the interest, education, and understanding of logical and strategic approaches generally required for such successful completion of the game. For example, U.S. Pat. No. 1,714,792 to Kurihara discloses a game in which victory is achieved by the first player who places on the game board a straight unbroken line of five playing members of the same color.

Other games are well known in which two or more players each compete to place a row or column of like-denominated playing pieces so as to achieve success when a pre-determined number of those pieces are so aligned. For example, U.S. Pat. No. 1,206,334, to Kohler discloses a plurality of parallel grooves provided in a game board, in which markers are directly placed into each groove by two or more players. However, only a single dimension of play is achieved in this game which is necessarily limited to the single direction of play along that single set of parallel grooves. U.S. Pat. No. 1,700,016 to Blanger discloses a checker board having a series of intersecting grooves in which checkers are positioned, those checkers being retained in the grooves and removed only when an intersection of the game board so allows. U.S. Pat. No. 2,528,792 to Seaman discloses a game board having a rectilinear array of grooves, to which spherical playing pieces are inserted. However, none of the aforementioned prior art games employs the broad concept of intersecting grooves in which opposing players direct their pieces so as to prevent subsequent alignment of an opposing player's playing pieces applied to the game board from a different orientation.

SUMMARY OF THE INVENTION

In view of the foregoing, there is provided a board game, and a method of playing thereof, in which a plurality of playing pieces are placed in a preselected pattern (such as a straight line of four playing pieces) on a game board having a grid of intersecting grooves. Each player or team of players inserts into one of two open sides of the game board and advances within the grooves extending therefrom a plurality of directionally-oriented playing pieces in a direction of travel coincident with the grooves, and strategically placed to block a playing piece advanced along a perpendicular groove. More particularly, the game board includes two sets of parallel grooves one set perpendicular to and intersecting with the other set. Each groove is sized to receive a directionally-oriented protrusion such as a rib extending from the underside of a playing piece, which is slidably received within a selected groove and advanced there-through thereby retaining the playing piece in the selected groove while allowing the underside of the playing piece to slidably engage with the top side of the playing board. Each playing piece is square shaped (or other regular shape, such as a round shape), having side dimensions equal to the spacing between adjacent parallel grooves. The game board includes four sides, two of which are closed, the other two of which are open through which the playing pieces are inserted. The game board is supported in an inclined or tilted orientation by a support member hingedly mounted to the underside of the game board, to incline the game board about a corner portion thereof at the convergence of the two closed sides. The game-playing pieces are distributed by color designation to two players or two teams of players.

The game is played by sequential placement by each player or team of players by slidably inserting a playing piece into a selected groove at or through an open side of the game board and then slidably advancing it along that groove by force of gravity until it abuts a closed side portion or another playing piece previously advanced along either sets of grooves. Strategic orientation and advancement of the playing pieces via the other open side of the game board, i.e., and thus along a selected perpendicularly-oriented groove, blocks subsequent placement of an opposing player's piece as necessary to achieve the preselected number and pattern of playing pieces. Thus, the method of playing the game of the present invention requires strategic analysis and foresight so as to block desired sequential alignment of playing pieces by opposing player(s) to achieve victory.

Victory is achieved, according to the first embodiment of the invention, when four playing pieces of the same color are aligned either horizontally, vertically, or diagonally in consecutive, unbroken order. Alternatively, victory is achieved when the four playing pieces (or alternate number of playing pieces) are placed in an L-shape, T-shape or zigzag alignment (or other predetermined alignment) as agreed to by the players or according to a set of rules.

With the foregoing and other objects and advantages and features of the present invention that will become hereinafter apparent, the nature of the board game of the present invention may be more clearly understood by reference to the following detailed description of the invention, the appended claims, and to the several views illustrated in the attached drawings.

DETAILED DESCRIPTION OF THE INVENTION

Figure 1:
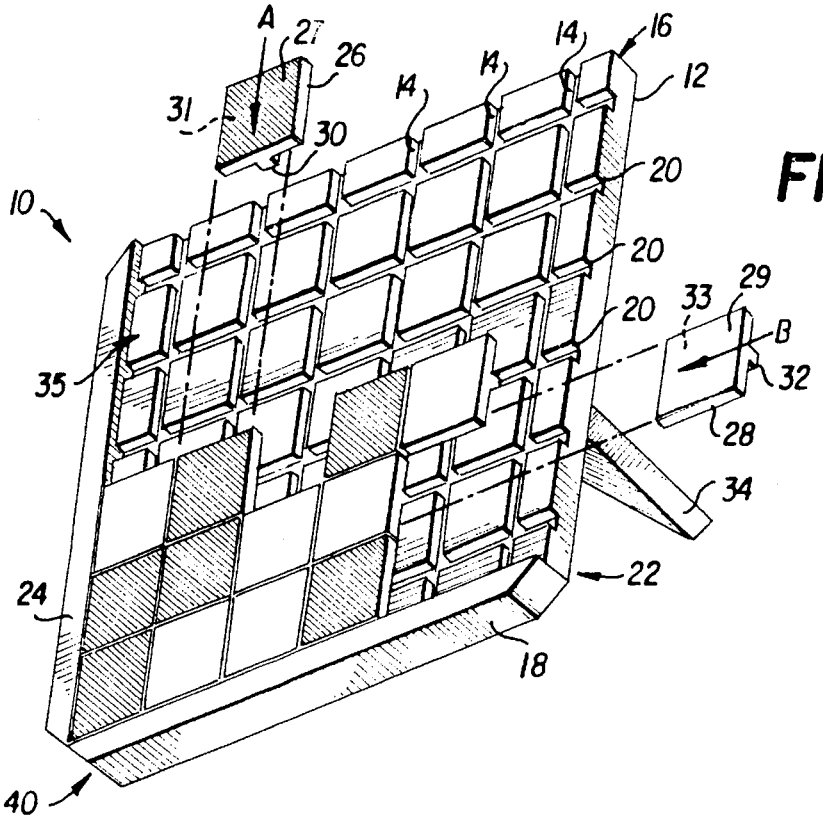
FIG. 1 is a perspective from view of the board game of the present invention showing a game playing board having two sides each opening to a set of parallel grooves, the two sets intersecting in perpendicular orientation, and a closed side opposite to each open side, further showing insertion of two square playing pieces having groove-engaging protrusions being inserted into two grooves through each of the open sides, and a plurality of square playing pieces so inserted and advanced into final positions in the game board.

Referring now to the drawings wherein like parts are designated by like reference numerals throughout, there is illustrated in FIG. 1 a game playing board 10 having a planar playing surface 12. According to the invention the game playing board 12 includes a grid-like arrangement of intersecting grooves. More particularly, the game playing board 12 includes a first set of equally spaced, parallel grooves 14 extending from a first open side 16 of the game playing board 12 to an opposing closed side 18 of the board 12. In like manner, a second set of equally spaced, parallel grooves 20, perpendicular to the first set of grooves 14, extend from a second open side 22 of the game playing board 12 to an opposing closed side 24 of the game playing board 12. All of the grooves 14, 20 are of constant width and depth, thereby providing uniform channels of passage from the open sides 16, 22 to opposing closed sides 18, 24, respectively, the importance of which will be made clear hereinafter.

According to the preferred embodiment of the invention, the first set of grooves 14 are parallel to the second closed side 24, and the second set of grooves 20 are parallel to the first closed side 18. For a like number of first grooves 14 and second grooves 20, the resulting game board is square in plan view, although it will be apparent to the skilled artisan that a game board having a plurality of first grooves 14 different in quantity from the second grooves 20, having even and equal spacing therebetween, can be configured to have a rectangular or other geometric shape in plan view.

Figure 2:
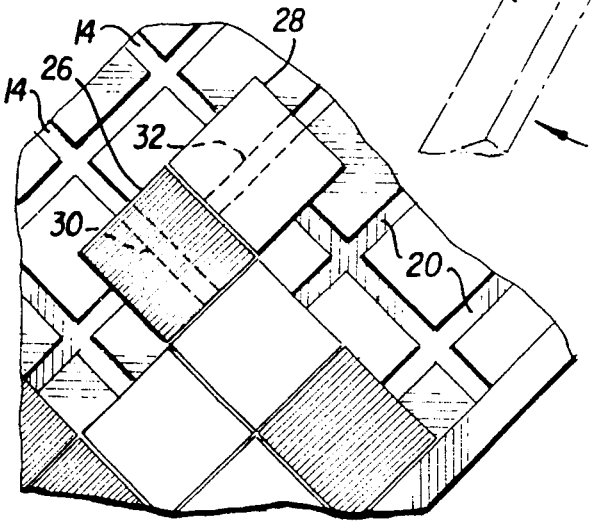
FIG. 2 is a detailed view of FIG. 1, showing the protrusions of the playing pieces engaged in an exemplary blocking orientation on the game board.

The game includes at least two sets of game playing pieces 26, 28 each having a top planar portion 27, 29, respectively. Each top planer portion 27, 29 preferably square- shaped, although such geometric shape is not necessarily limited to such rectilinear shapes as will be apparent to the skilled artisan. For example, each playing piece 26, 28 may have another regular shape, such as a circular shape. For any selected shape, the widest lateral dimension thereof will be equal to the spacing between adjacent parallel grooves. Each of the first set of playing pieces 26 includes a first player or team denominator such as a selected color designation on the top planar portion 27 thereof. Likewise, each of the second set of playing pieces 28 includes a second player or team denominator such as a selected color designation on the top planar portion 29 thereof different from the first color designation. Each of the square playing pieces 26, 28 includes a straight rib 30, 32 provided at the midline of the underside of each of the pieces 26, 28, respectively, which extend deeply enough to retain the playing pieces 26, 28 in the selected groove while allowing the underside portions 31, 33, respectively, to slidably engage with the top planar surface 35 of the playing board 12. Accordingly, the ribs 30, 32 are parallel to opposing sides of the pieces 26, 28 so that in use the sides of adjoining playing pieces 26, 28 do not block advancement therebetween as they are advanced through the grooves 14, 20. Each rib 30, 32 is sized and configured to be slidably received within the grooves 14, 20 during the play of the game, as will be more fully described. More particularly, and as can be seen in FIG. 2, the rib 30 of playing piece 26 is shown being advanced into a groove 14 at the first open side 16, perpendicular to the direction of insertion and advancement of the rib 32 of a playing piece 28 as installed in a groove 20. Thus, a playing piece is effectively blocked by a previously inserted playing piece which was inserted through a perpendicular groove. However, playing pieces placed in adjacent parallel grooves are slidably advancable past one another with no contact, or at most, sliding contact between parallel side walls.

Figure 3:
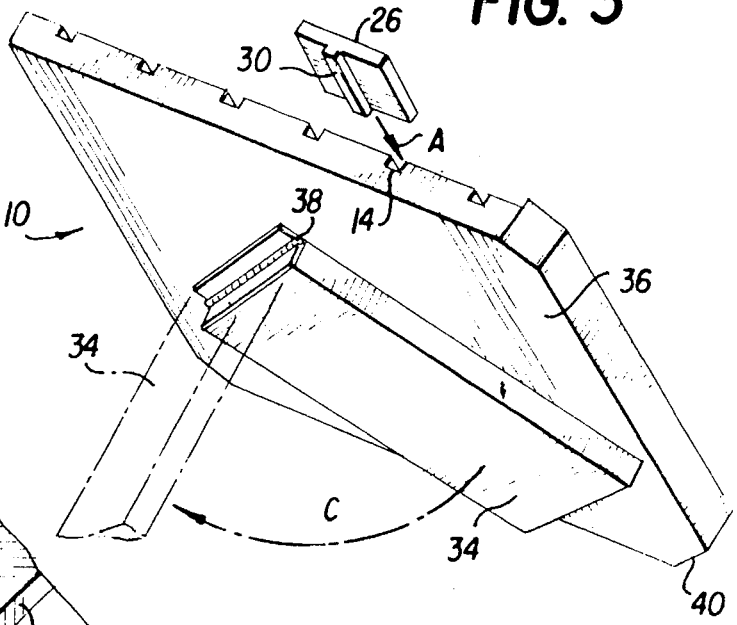
FIG. 3 a rear perspective view of the game playing board of FIG. 1, showing a hinged support member which, in the extended position, orients the game playing board in an inclined playing position.

With reference now to FIG. 3, the game playing board 12 further includes a support 34 pivotally supported to a backside 36 of the game playing board 12 by a hinge 38. The support leg 34 is pivoted outwardly of the plane of the game playing board 12 in the direction of arrow C to an extended position at about 90° to the plane of the board 12, as shown in phantom to support the game board 12 in an inclined position about an apex 40 of converging closed sides 18, 24. In this orientation, playing pieces 26 advanced into groove 14 in the direction of arrow A (FIG. 1) is drawn downward by the force of gravity against the opposing closed side 18 or against upward sides of previously inserted playing pieces 26, 28. Likewise, playing piece 28 is advanced in the direction of arrow B (FIG. 1) and drawn downward by the force of gravity in the manner so described. Accordingly, a total of 36 playing pieces may be accommodated in the game board 12 having two sets of six grooves. Alternatively, the game board 12 may be configured to have a lesser or greater number of grooves in each orthogonal direction, thereby using a lesser or greater number of playing pieces as dictated by each configuration.

The game board 12 is constructed of wood, injection-molded plastic, or other readily-machined material. Optionally, the game board 12 is constructed with four open sides, to which two longitudinal members are affixed to form closed sides 18, 24. The playing pieces 26, 28 are fabricated from a wood such as balsa wood, injection-molded plastic, or other material. The ribs 30, 32 are either integrally formed with the playing pieces 26, 28 or are affixed thereto with suitable attachment means such as glue, rivets or the like.

PLAYING THE GAME

Prior to playing the game, the first set of game playing pieces 26 is assigned to a first player or team of players, and the second set of game playing pieces 28 equal in quantity to the first set of game playing pieces 26 is assigned to a second player or team of players. To begin play, one player or team of players is selected as mutually agreed upon, and a first playing piece 26 is slidably received in a first groove 14 or 20 as desired. The game playing piece is slidably directed as far along the groove 14 or 20, preferably under the force of gravity, until it makes abutting contact with a closed side 18 or 24, or as will be more fully described below against a one side of a previously placed playing piece 26, 28.

The game proceeds with the opposing player or team of players inserting their game playing piece 28 into the selected groove 14, 20, and fully directing the piece along the groove under the force of gravity until it reaches a closed side 18, 24, or another playing piece.

The game proceeds in alternating fashion whereby the playing pieces 26, 28 are inserted as strategically desired by each player or team of players until four playing pieces of the same color are arranged in a line (horizontal, vertical, or diagonal when the playing board is viewed orthogonally) on the game playing board 12. It will be apparent that advancing a player's piece along a strategically selected one of the sets of grooves 14, 20 i.e., perpendicular or parallel to previously inserted pieces, will enable either player or team of players to block the opposing team, thereby preventing achievement of the desired line (or other predetermined pattern) of game playing pieces.

The game ends either when one player or team of players achieves a line (or other predetermined pattern) of four playing pieces of the same color, or when no more playing pieces can be inserted into the game playing board and no line having a sufficient number of playing pieces of the same color can be achieved.

Alternatively, the players may decide before the start of the game to assign victory to the first team to achieve tour pieces in an "L" shape, a "T" shape, or a zigzag pattern of predetermined orientation. For a number of players in excess of two, the players are divided into two teams, and the play of the game alternates between the two teams, with each player in each team taking an alternating turn. Optionally, communication between players of the same team may be prohibited so that each move is based on the independent decision of each player. For the instance that the game ends in a tie, i.e., a line of four consecutively placed pieces is not achieved, each player/team of players tallies the number of instances of three playing pieces placed in a row. That player/team of players having the greatest number of three-piece sequences is declared the winner. Alternatively, the scoring scheme described immediately above for a tie-breaker may be adopted as the primary game-scoring approach. Another alternative game-scoring approach assigns victory to the player/team of players which accumulates the greatest number of three-piece sequences, without any four-pieces sequences, which is an automatic loss for that player/team of players.

Furthermore, it is contemplated that the support arm 34 may be retracted into a collapsed position against the back of the game board 12 to enable play of the game 10 in a horizontal position, following the rules described above. It will be appreciated that the play of such game in a horizontal position will thereby be made possible in close quarters such as in automobiles, aircraft, or in other locations where a stable and sturdy playing surface is not available so as to allow for the inclined position of the playing board. Accordingly, each player manually advances the playing pieces 26, 28 along the grooves 14, 20 in the manner previously described, after inserting the piece through an open side 16 or 22; i.e. without "jumping" any previously inserted playing pieces so as to gain an unfair advantage.

Although a preferred embodiment of the board game of the present invention has been described herein and fully illustrated by the drawing figures, it will be apparent to those skilled in the art to which the invention pertains the variations and modifications of the described embodiment may be made without departing from the spirit and scope of the invention. Accordingly, it is intended that the invention be limited only to the extent required by the appended claims and the applicable rules of law. .

I claim:

1. A board game, comprising:

a game board having a top surface and a bottom surface;

a first wall member extending above said top surface at one side thereof;

a second wall member extending above said top surface at an adjacent side thereof;

a first plurality of spaced grooves provided in the top surface, and a second plurality of spaced grooves intersecting with the first plurality of grooves, wherein said first plurality of grooves extends in a first direction from said first wall member to a first open side of said game board, and said second plurality of grooves extends in a second direction from said second wall member perpendicular to the first direction to a second open side of said game board; and a set of playing pieces, adapted to slide along the grooves from the first or second open sides, each of which includes a protrusion having a depth, a width no wider than a width of any of said grooves, and a length greater than the width of any of said grooves.

2. The board game of claim 1, wherein each playing piece includes a planar portion having a width and a height of equal dimension, both dimensions equal to the spacing between adjacent parallel grooves, and wherein the protrusion extends from the planar portion along a midline between a selected pair of opposing sides of the playing piece.

3. The board game of claim 2, wherein the set of playing pieces is divided into at least two subsets, further including means for denominating each said subset.

4. The board game of claim 3, wherein said first plurality comprises at least six parallel, equispaced grooves, and said second plurality comprises at least six parallel, equispaced grooves.

5. The board game of claim 1, wherein each said playing piece includes a square planar portion having a top surface, a bottom surface, two pairs of opposing sides between said top surface and said bottom surface, and said protrusion is a rib extending from said planar portion between a first selected pair of opposing sides intermediate to the second pair of opposing sides.

6. The board game of claim 1, wherein said first and second wall members converge to a corner portion of said game board, and means for inclining said game board about said corner.

7. The board game of claim 6, wherein said inclining means is a leg member hingedly secured to said bottom surface of said game board.

8. The board game of claim 6, wherein said inclining means is adjustable through an angle of about 90 degrees relative to the plane of the game board.

9. The board game of claim 6, wherein said playing pieces are advanced through the grooves under the force of gravity when the game board is in the inclined position.

* * * * *